US005898371A

United States Patent [19]

Marek

[11] Patent Number: 5,898,371

[45] Date of Patent: Apr. 27, 1999

[54] BOX WITH DETECTING MEANS

[76] Inventor: Yochai Marek, Norrskogsvagen 12, S-141 41 Huddinge, Sweden

[21] Appl. No.: 09/000,471

[22] PCT Filed: Jul. 12, 1996

[86] PCT No.: PCT/SE96/00952

§ 371 Date: Jan. 23, 1998

§ 102(e) Date: Jan. 23, 1998

[87] PCT Pub. No.: WO97/05812

PCT Pub. Date: Feb. 20, 1997

[30] Foreign Application Priority Data

Aug. 7, 1995 [SE] Sweden ..... 9502762

[51] Int. Cl.[6] ..... G08B 13/14

[52] U.S. Cl. ..... 340/569; 200/61.63; 232/34; 232/36

[58] Field of Search ..... 340/569, 568, 340/570, 545, 546; 200/61.63; 232/34, 35, 36, 17, 37

[56] References Cited

U.S. PATENT DOCUMENTS

| | | | |
|---|---|---|---|
| 1,186,772 | 6/1916 | Hammons | 340/569 |
| 2,438,785 | 3/1948 | McKallick | 340/569 |
| 2,469,558 | 5/1949 | Jaskala | 340/569 |
| 4,651,135 | 3/1987 | Duhaime et al. | 340/569 |
| 5,377,906 | 1/1995 | Mason | 232/34 |

FOREIGN PATENT DOCUMENTS

| | | | |
|---|---|---|---|
| 6664081 | 8/1981 | Australia . | |
| 2687298 | 8/1993 | France . | |
| 442790 | 4/1927 | Germany | 340/569 |
| 2245951 | 3/1974 | Germany . | |

*Primary Examiner*—Daniel J. Wu
*Assistant Examiner*—Sihong Huang
*Attorney, Agent, or Firm*—Young & Thompson

[57] ABSTRACT

The present invention relates to a box, particularly a mailbox which includes a lid, detecting and indicating elements for detecting and indicating the presence of one or more objects, such as letters and newspapers. The detecting elements include a pivotally mounted member (30) which is coupled to the lid (7) of the box, via a transmission (60–67), for moving the pivotally mounted member (30) from an initial position in response to the opening of the lid (7). The pivotally mounted member (30) is arranged to automatically return to its initial position as the lid (7) is closed, if no object is present in the box. If an object is present in the box, the pivotally mounted member (30) is prevented from returning to its initial position, in which position the pivotally mounted member (30) is so arranged and positioned that it activates an indicating member.

19 Claims, 5 Drawing Sheets

BOX WITH DETECTING MEANS

TECHNICAL FIELD

The present invention relates to a box with detecting means, and in particularly to a mailbox according to the preamble of claim 1, which is based on AU-A1-66 640/81.

Such a box will find its primary use as a mailbox which is placed with some distance to a house, and therefore it will be described as such. However, it should be apparent to a person skilled in the art that such a box can be used in other applications, where it is of interest to receive information from a distant position whether an object has been placed in the box or if it is empty.

A mailbox is usually placed at the road on a distance from the house, which makes it difficult for the one receiving the mail to get a proper indication if an object, such as a letter or a newspaper, has been placed in the mailbox.

BACKGROUND ART

AU-A1-66 640/81 describes a mailbox which comprises a detector identifying the presence of an object. How the detector is constituted is not described, except that it can be of any kind and preferably an optical sensor. The main problem to be solved by this patent is the transmission of the detected signal to an indication device. This is done by means of radio waves sending a signal to a receiver as soon an object has been detected.

DISCLOSURE OF THE INVENTION

The objective problem to be solved by the present invention is to accomplish a box comprising detecting means which have a simple and an inexpensive design and which in a reliable way detects and indicates the presence of small and large objects in the box.

The objective problem is solved by the characterising part of claim 1.

Preferred embodiments of the present invention are described in the dependent claims.

The solution according to the present invention with mechanical detecting means arranged inside the mailbox will in a reliable way detect any object inside the mailbox. Compared to an optical solution which often is used in prior art devices, the detecting means in the present invention is easy to manufacture and operate and does not require any calibration in order to operate. A particular advantage is that the manufacturing tolerances for the detecting means is not as critical as in prior art devices with optical solutions leading to cheaper manufacturing costs. Furthermore, the solution according to the invention is able to in a reliable way detect even very small objects, does not need any maintenance as many of the prior art devices and the detecting means will last for a long time. Thus, there is provided a mailbox which is inexpensive to purchase and in maintenance and which in a reliable way detects small objects better than any to the inventor known mailbox.

BRIEF DESCRIPTION OF THE DRAWINGS

The present invention will now be described closer together with the accompanying drawings, in which.

MODE FOR CARRYING OUT THE INVENTION

Figure 1:
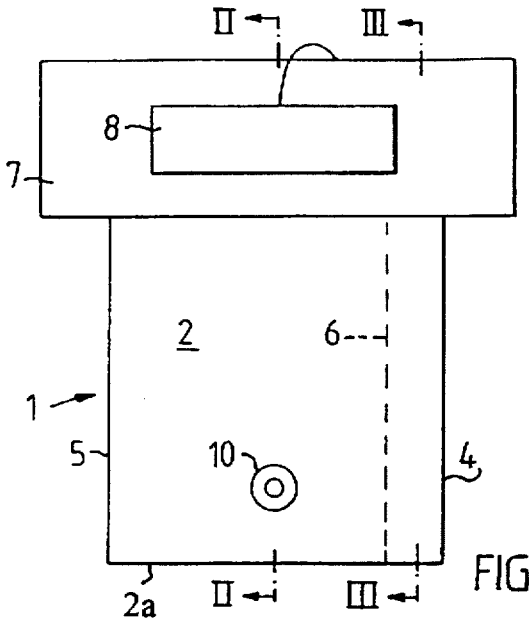
FIG. 1 shows a front view of a box according to the present invention.

FIG. 1 schematically shows a mailbox 1 comprising four vertically orientated walls 2, 3, 4 and 5 giving the mailbox 1 its outer shape, a vertical wall 6 placed inside the mailbox 1, a lid 7 which is pivotally attached with a hinge to the upper edge of the rear wall 3 of the box 1, a solar cell 8, a power supply 9 (FIG. 2) and indicating means 10.

The indicating means 10 may be an optical indicator, such as a light source, which is supplied by the power supply 9, such as a battery. The battery may optionally be charged by the solar cell 8, preferably mounted on top of the lid 7. However, it should be noted that whether the power supply 9 nor the indicating means 10 are limited to the above. The power supply 9 could be of any conventional type, such as the mains, the battery, the solar cell 8 or any combination thereof. The indicating means 10 could as an example also be realised by an acoustic indicator, or with a mechanical flag indicator and be placed anywhere, i.e. also remote from the mailbox 1. It is however preferred that the indicating means 10 are placed on or in the vicinity of the mailbox 1.

Figure 2:
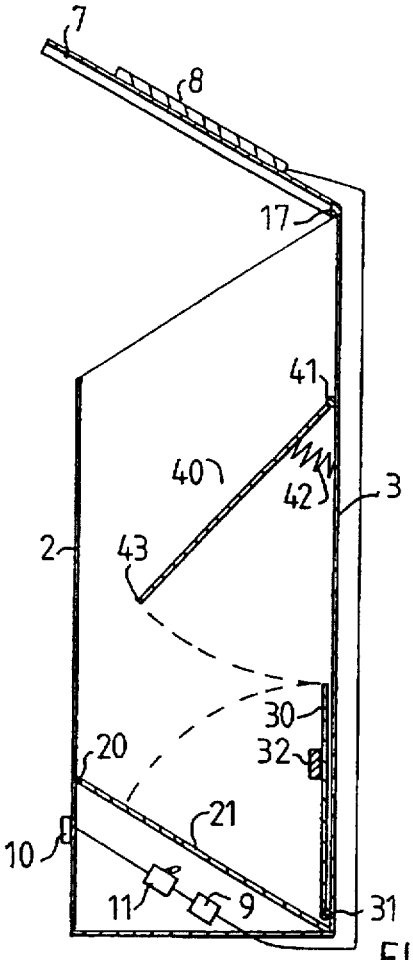
FIG. 2 shows a schematic illustration of a cross section along line II—II in FIG. 1.

FIG. 2 is a cross section of the mailbox 1 in FIG. 1 showing detecting means comprising a switch 11, a bottom plate 20, an opening 21, a pivotally mounted member 30, an axis 31, and a projection 32 and guiding means comprising a plate 40, an axis 41, and a pressure spring 42. As can be seen in FIG. 2 the bottom plate 20 is provided within the mailbox 1 and slants from the front wall 2 down to the rear wall 3. The bottom plate 20 is provided with at least one opening 21. Under the bottom plate 20 is provided a switch 11 corresponding to one of the openings 21. However, it shall be noted that the switch 11 may be provided in any other position as long as the pivotally mounted member 30 or the arm 60 (FIG. 3) which controls its movements is able to act on the switch 11. The switch 11 may be of any conventional type, such as a micro switch or a mechanical switch.

A pivotally mounted member 30 is provided with its axis close by the attachment of the bottom plate 20 to the wall 3. The pivotally mounted member 30 carries at least one projection 32 corresponding to the or each opening 21, i.e. the or each projection 32 will penetrate the or each opening 21 as the pivotally mounted member 30 abuts the bottom plate 20. One of the projections 32 is provided on the pivotally mounted member 30 in such a way that it affects the switch 11, if the projection 32 penetrates its corresponding opening 21. A letter or the like laying on the bottom plate 20 and covering at least one opening 21 will thereby prevent the projection 32 from affecting the switch 11. The indicating means 10 will only be activated if the projection 32 is prevented from penetrating its corresponding opening 21 as will be described in more detail in conjunction with FIG. 6.

In a preferred embodiment the pivotally mounted member 30 is constituted by a plate having approximately the same width as the bottom plate 20 and preferably extends to the front wall 2. It shall be understood that the pivotally mounted member 30 also could be an arm, a net or the like, the important being the function to pivotally affect the switch 11 if the mailbox is empty.

To secure that a letter that has been dropped in the mailbox 1 will come to rest on the slating bottom plate 20, a guiding plate 40 is provided pivotally mounted on the upper part of the mailbox 1. The plate 40 is pivotally carried by the horizontal axis 41 provided at the rear wall 3, the plate 40 slanting downwards from the axis 41. The plate 40 is held in its position by a pressure spring 42 acting between the rear wall 3 and the plate 40 in such a way that the free end 43 of the plate 40 together with the front wall 2 constitutes a guiding slot for thin objects, such as letters and other sheet shaped objects. Such objects will thereby obtain a suitable path and come to rest with its front edge against a stop at the lower edge of the plate 20 and with its main surface against the bottom plate 20. In this way small letters, sheets and the like are prevented from entering the space between the pivotally mounted member 30 and the rear wall 3 as will be described in more detail in conjunction with FIG. 5.

A newspaper or other larger objects will move the plate 40 against the rear wall 3, forcing the lid 7 to be more fully opened and the pivotally mounted member 30, connected to the lid 7 with a transmission 60–67, will thereby be moved to its end position against the rear wall 3 before the object is placed in the mailbox 1. Thus, there will be no danger that large objects such as newspapers will reach the space between the rear wall 3 and the pivotally mounted member 30.

However, it shall be noted that the guiding plate 40 is not critical in carrying out the invention. Depending on the gear change of the transmission 60–67, described below in conjunction with FIG. 3, it can be secured that the pivotally mounted member 30 is in its upright position before the mail is dropped in the box. The lid 7 may also be designed in such a way that one has to open the lid 7 a certain degree before mail can be dropped into it, said opening degree of the lid 7 corresponding to the upright position of the pivotally mounted member 30.

Figure 3:
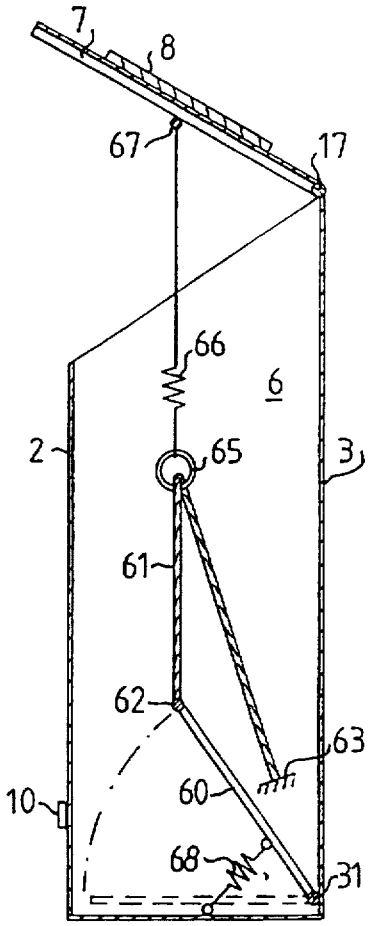
FIG. 3 shows a schematic illustration of a cross section along line III—III in FIG. 1.

FIG. 3 is a cross section along line III—III in FIG. 1 and shows the transmission between the lid 7 and the pivotally mounted member 30. The transmission comprises a radial arm 60, a pull wire 61, a ring 65, and a pull spring 66. The transmission is separated from the mailbox 1 by the wall 6.

The radial arm 60 is fixedly attached to the axis 31, which is the axis around which the pivotally mounted member 30 pivots. Since the axis 31 is fixed to the arm 60 it will rotate together with the arm 60 and since the pivotally mounted member 30 also is fixed to the axis 31 it will pivot together with the axis 31 in response to the movement of the arm 60. One end 62 of the pull wire 61 is attached to the arm 60 and the other end 63 is attached to the wall 6, the pull wire 61 extending slidingly through a ring 65 to which one end of a pull spring 66 is attached, the other end 67 of the pull spring 66 being attached to the lid 7. It shall be understood that the ring 65 may be substituted by a wheel or any other suitable means through which or on which the pull wire 61 can glide or slide. By arranging the pull wire 61 in such a way a gear change is obtained that speeds up the movement of the pivotally mounted member 30 towards the rear wall 3 as the lid 7 is opened. Furthermore, the pull spring 66 allows a certain extensibility for the transmission, which will reduce the strain on the transmission and allow the lid 7 to be opened further when the pivotally mounted member 30 already has reached its end position against the rear wall 3.

The transmission forces the pivotally mounted member 30 to move fast to its end position even for relatively small opening angles of the lid 7, whereafter the lid 7 can be further opened by the expansion of the pull spring 66. The transmission may for example be designed to transmit an angular movement to the pivotally mounted member 30 that is 2, 3, 4, 5 or even 10 times the angular movement of the lid 7.

A return spring 68 will secure that the pivotally mounted member 30 is brought back to its initial position against the bottom plate 20 as the lid 7 is closed. The return of the pivotally mounted member 30 to its initial position could however, preferably, also be secured by that the point of balance for the pivotally mounted member 30 and its associated parts is on the left hand side of the vertical plane of the axis 31. The point of balance may then for example be adjusted by means of a weight (not shown) provided on the pivotally mounted member 30 in such a way that the mail dropped into the mailbox reaches the bottom plate 20 before the pivotally mounted member 30 returns to its initial position.

The transmission may also be realised by means of a electromagnetic solution (not shown). In this case the lid 7 will activate a switch as it is opened, which in turn activates a solenoid connected to the pivotally mounted member 30.

It shall be understood that the transmission also could be manipulated by other means than the lid 7. For example, the postman may push a switch, or there may be a photo cell detecting that mail is dropped into the box, which in turn activates the transmission to move the pivotally mounted member 30 to its upright position.

Figure 4:
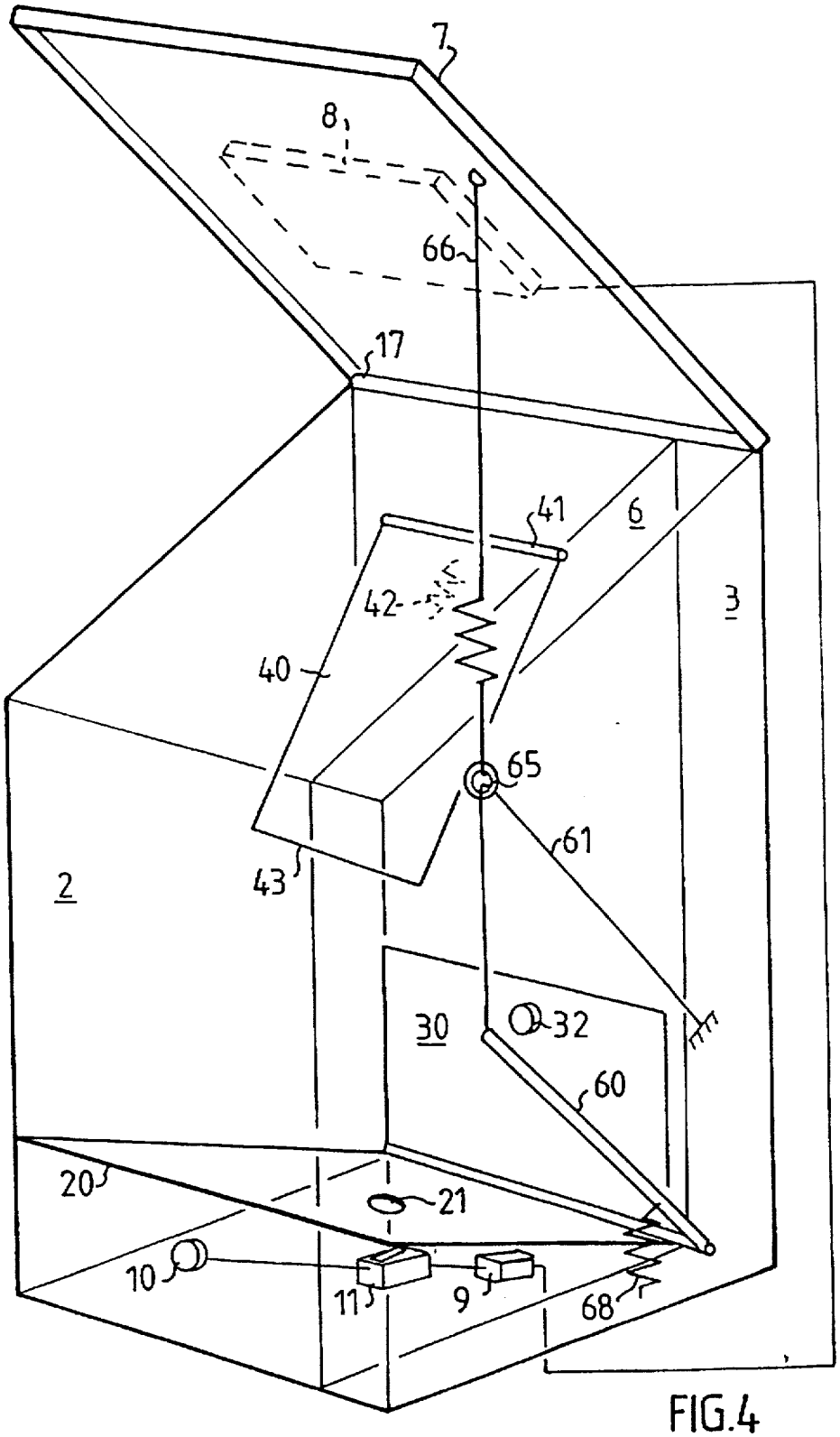
FIG. 4 shows an isometric transparent illustration of the objects in FIGS. 1 to 3.

FIG. 4 shows an isometric transparent illustration of the objects in FIGS. 1 to 3.

Figure 5:
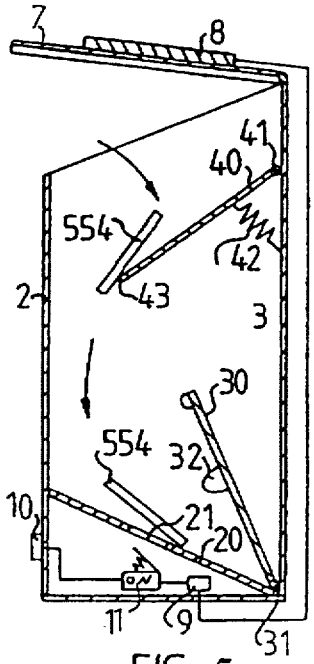
FIGS. 5–7 show the box according to FIG. 2 in different modes of operation.

FIG. 5 shows an example of the path (arrows) for a letter 554 or the like that is dropped in the mailbox 1, with the lid 7 having a small opening angle and where the transmission not yet has driven the pivotally mounted member 30 to its end position. As can be seen the guiding plate 40 prevents the letter 554 from reaching the space between the rear wall 3 and the pivotally mounted member 30 and guides the letter to the space between the pivotally mounted member 30 and the bottom plate 20 in such a way that the letter will come to rest on the bottom plate 20 and cover the opening 21.

Figure 6:
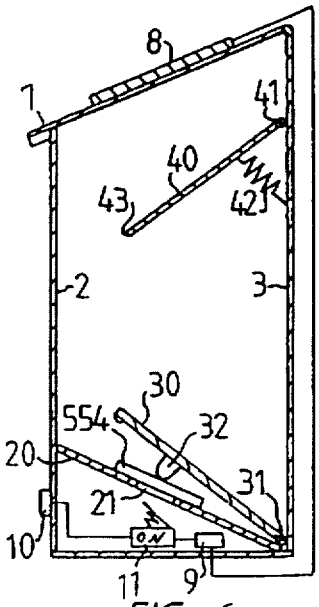

FIG. 6 shows that the pivotally mounted member 30 automatically will move towards its initial position as the lid 7 is closed and that the letter 554 will prevent the projection 32 from affecting the switch 11.

Figure 7:
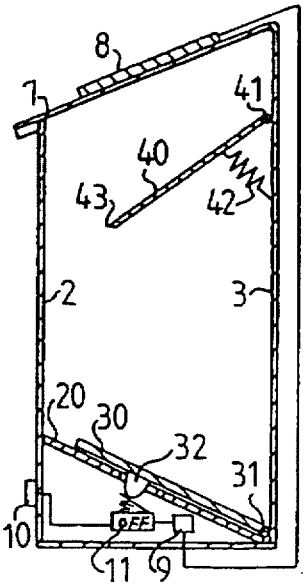

FIG. 7 shows that the projection 32 on the pivotally mounted member 30 will affect the switch 11 when the box is empty.

Figure 8:
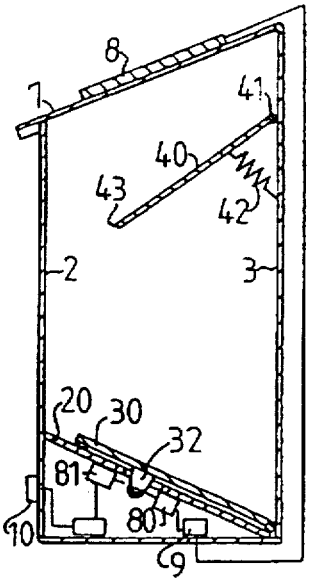
FIGS. 8–9 show two modifications of the box according to FIG. 2.

FIG. 8 shows an embodiment that is analogous with the embodiment in FIGS. 5 to 7, but where the shown switch, preferably a micro switch is substituted by an opto electric switch comprising a light source 80 that directs a light beam towards a photo cell 81 provided under the bottom plate 20, the light beam being interrupted by the projection 32, if it penetrates the opening 21.

Figure 9:
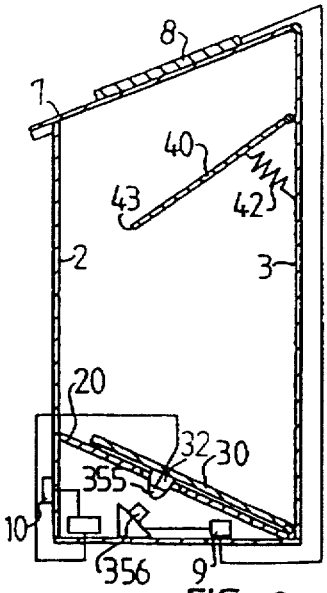

FIG. 9 shows a further embodiment of the switch having the form of a magnetic switch, a ferro magnetic body 355 being provided on the free end of the projection 32 in order to affect an element in the switch 356 into a switching position when the projection 32 penetrates the opening 21.

It should be noted that the type of switch 11 used in the present invention or its position is not critical, the important thing being that the switch 11 will be affected by the pivotally mounted member 30 or the arm 60 if no object is present in the mailbox and thereby prevent that the indicating means 10 are activated. However, if an object is present in the mailbox the switch 11 will not be affected by the pivotally mounted member 30 and the indicating means 10 are activated. If the switch 11 is a mechanical switch the indicating means 10 could also be mechanical, such as a mechanical flag. The flag will raise into an upright position in response to the opening of the lid 7 and will stay in this upright position if mail has been dropped in the box, in which case the pivotally mounted member 30 is prevented from returning to its initial position.

Figure 10:
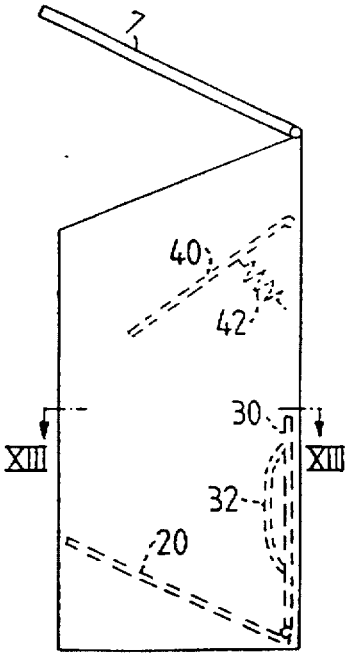
FIG. 10 shows one further modification of the box according to FIG. 2.
Figure 11:
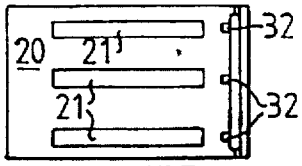
FIG. 11 shows a cross section taken along line XIII—XIII in FIG. 10.

The embodiment in FIG. 10 corresponds to the embodiment in FIG. 2 except for the fact that the projection 32 has been substituted by a plurality of elongate projections, preferably three as shown in FIG. 11. The elongate projections extend substantially perpendicular to the axis 31 over a length that preferably is more than half the length of the bottom plate 20. As can be seen in FIG. 11 the bottom plate 20 has openings 21 corresponding to each of the elongate projections 32. The elongate projections 32 and their corresponding openings 21 exhibit relatively large dimensions in order to prevent the projections 32 from perforating the object to be detected such as a letter. The elongate projections 32 will also increase the reliability of the detecting means, i.e. it is able to detect smaller objects, since they cover a larger surface of the bottom plate 20.

The function of the detecting means 11, 20, 21, 30, 31, and 32 is not always dependable on that the object to be detected covers the openings 21, i.e. it is enough if the pivotally mounted member 30 is prevented from reaching the bottom plate 20. The advantage with a plurality of projections 32 and corresponding openings 21 is that even a very small letter will be detected in a reliable way. It shall be noted that the detection function can be carried out without the opening 21 in the bottom plate 20 and the projection 32 if the object to be detected is large enough to prevent the pivotally mounted member 30 or the arm 60 from affecting the switch 11. However, the solution with the opening 21 and projection 32 is preferred, since it is able to detect all objects.

FIG. 12A–12D shows a further embodiment of the present invention comprising removable locking means. The locking means has two purposes, firstly it will lock the mailbox to keep out any intruder from emptying the mailbox, and secondly it will serve as a support for the lid 7 when emptying the mailbox, i.e. it will keep the lid 7 in an upright position. The locking means comprises a plate 54 having two openings 52 and 53, a removable axis 58 provided with a safety pin 57, a locking mechanism 55 and 56 provided on the front wall 2 of the mailbox and a stop projection 51 provided on the lid 7.

Figure 12A:
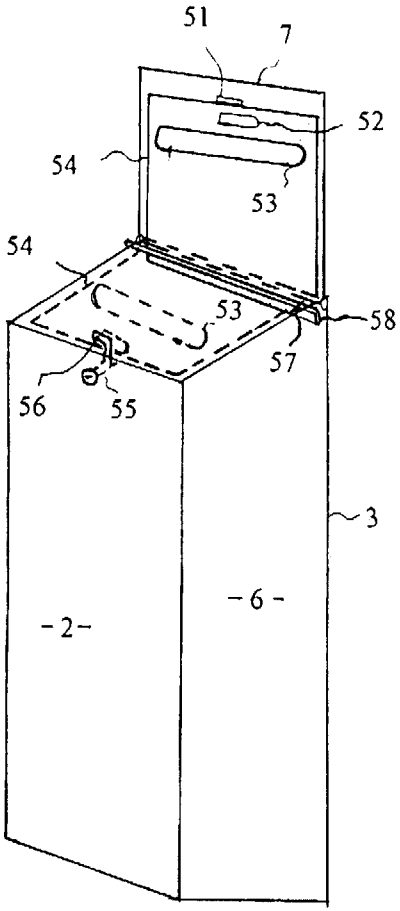
FIGS. 12A–D show embodiments of the present invention comprising locking means.
Figure 12B:
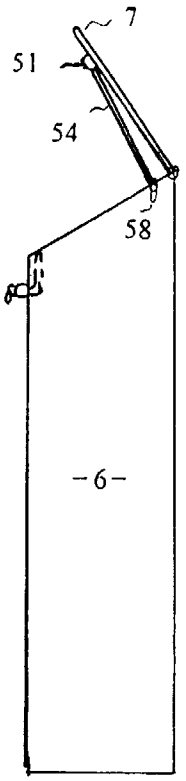

FIG. 12A shows the locking plate 54 in two different positions. In the first position, shown with solid lines, the locking plate 54 is in its upright position keeping also the lid 7 in an upright position by resting on the stop projection 51 (see FIG. 12B). In the second position, i.e; the closed position, shown with dotted lines, the plate 54 is locked by the locking mechanism 55 and 56 to prevent any intruder from accessing the mail in the mailbox.

The locking plate 54 is provided with two openings one of which 52 corresponds to the locking mechanism 55 and 56 and which size is adapted to securely keep the locking plate 54 locked. The size of the other opening 53 is adapted in such a way that it will allow mail, such as letters and newspapers, to be dropped through the opening 53, but prevent intruders from reaching the mail through the opening 53.

Figure 12C:
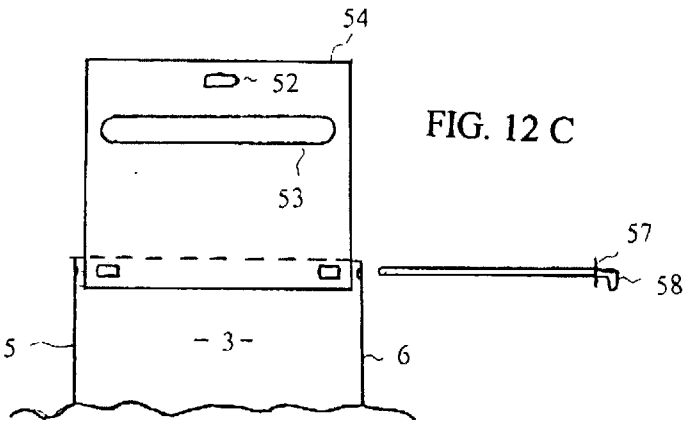

FIG. 12C shows how the locking plate 54 is removable provided on the mailbox. The axis 58 carries a safety pin 57 which can be removed easily. By removing the safety pin 57 the axis 58 can be removed, whereafter the locking plate 54 also can be removed. The safety pin 57 is provided on the axis 58 in such a way that when the axis 58 is in its proper place (FIG. 12A) it is prevented from sliding out. The idea of making the locking plate removable is to give the customer a choice whether he wants to use it or not.

Figure 12D:
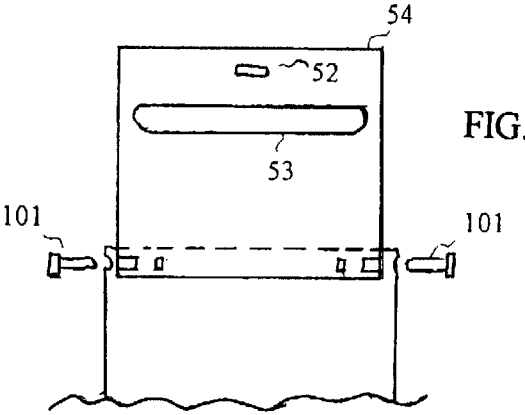

In FIG. 12D a second embodiment of the locking plate 54 is shown where two screws 101 are used instead of the axis 58 to attach the locking plate 54 in a removable way.

Figure 13:
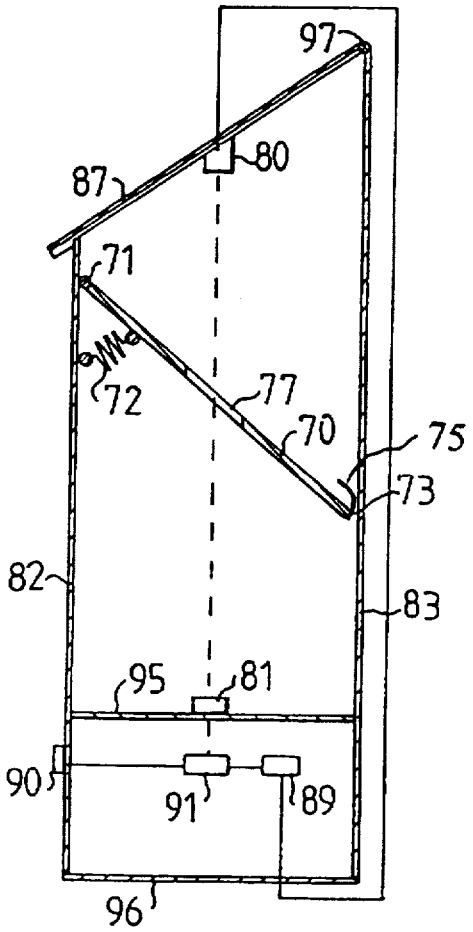
FIG. 13 shows a cross section through an alternative embodiment of the box.

FIG. 13 shows a cross section, corresponding to section II—II in FIG. 1, through an alternative embodiment of the box. The box is provided with two vertically spaced bottom plates 95 and 96, whereinbetween a space is provided containing a switch 91 and a power source 89.

Inside the box is provided a plate 70 arranged on a side wall 82 of the box in a similar way, but on the opposite wall, as the plate 40 in the embodiment of FIG. 2. The plate 70 extends such as the free end 73 of the plate 70 almost touches the side wall 83. A hook 75 may optionally be provided on the free end 73 of the plate 70 in order to prevent a thin letter or sheet from slipping trough the gap between the side wall 83 and the free end 73 of the plate 70. The plate 70 is pivotally mounted on the side wall 82 extending downwards towards the side wall 83. A spring 72 is acting on the plate 70 to keep it biased in the position shown in FIGS. 13 and 14. The box is provided with a light source 80 which radiates light towards a photo cell 81. The photo cell 81 is arranged to control a switch 91 connected between indicating means 90, such as a lamp, and a power source 89 in such a way that the indicating means 90 is activated if the photo cell 81 is screened from incident light, for example by a letter or news paper. The light source 80 and the photo cell 81 may be attached at two opposite walls of the box.

Figure 14:
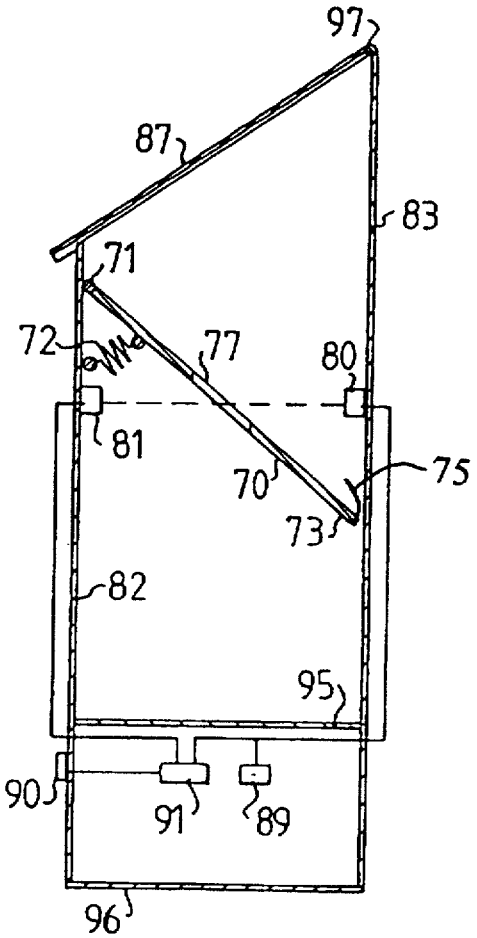
FIG. 14 shows a modification of the embodiment according to FIG. 13.

In the embodiment according to FIG. 13 the plate 70 is provided with an opening 77 corresponding to the light beam from the light source 80, i.e. the light beam will reach the photo cell 81 if the plate 70 is in its initial position (as shown with dotted lines in FIGS. 13 and 14). If the plate 70 is pivoted from its initial position it will screen the light beam and thereby activate the indicating means 90, since no light reaches the photo cell 81. In the embodiment of FIG. 13 the light beam has a substantially vertical direction between the light source 80 and the photo cell 81. The embodiment of FIG. 14 corresponds largely to the embodiment of FIG. 13 except for the fact that the direction of the light beam between the light source 80 and the photo cell 81 is substantially horizontal.

If a letter or news paper is dropped in the box it will prevent the light beam from the light source 80 to reach the photo cell 81. If the object dropped in the box is light, such as a letter, the object will come to rest on the plate 70 covering the opening 77 and thereby interrupting the light beam path between the light source 80 and the photo cell 81, which in turn activates the indicating means 90. If the object dropped is heavy, such as a news paper, the object will press down the plate 70 and thereby preventing the light beam from passing the opening 77, which in turn activates the indicating means 90.

While FIGS. 13 and 14 show the opening 77 placed in the middle of the plate 70, it should be noted that the opening 77 may be placed anywhere on the plate 70 and that an opening 77 placed closer to the free end 73 of the plate 70 will facilitate detection of smaller objects.

While the invention has been described above in connection with the particular embodiments and examples, one skilled in the art will appreciate that the invention is not necessary so limited. It will thus be understood that numerous other embodiments, examples, combinations, modifications of, and departures from the teachings disclosed may be made, without departing from the scope of the present invention as claimed herein.

I claim:

1. A box comprising detecting means and indicating means for detecting and indicating the presence of one or more objects in the box, the detecting means comprising a pivotally mounted member (30; 60) which is coupled to a lid (7) of the box, via a transmission, for moving the pivotally mounted member (30; 60) from an initial position in response to opening of the lid (7), and in that the pivotally mounted member (30; 60) in response to the closing of the lid (7) is structured and arranged (a) to automatically return to the initial position if no object is present in the box, and (b) to be prevented from returning to the initial position if an object is present in the box, in which position the pivotally mounted member (30; 60) is structured and arranged so that it directly or indirectly activated the indicating means (10).

2. A box according to claim 1, characterised in that the box comprises an internal bottom plate (20) against which the pivotally mounted member (30; 60) acts in its initial position.

3. A box according to claim 2, characterised in that the internal bottom plate (20) against which the pivotally mounted member (30; 60) acts in its initial position, is provided with at least one opening (21) through which at least one corresponding projection (32) provided on the pivotally mounted member (30; 60) acts when the box is empty.

4. A box according to claim 3, characterised in that a switch (11), is provided under the at least one opening (21) of the bottom plate (20), the switch (11) being so arranged and positioned that the projection (32) corresponding to the switch (11) can be brought into engagement with the switch (11), from above, through the opening (21) of the bottom plate (20), when the box is empty.

5. A box according to claim 3, characterised in that a switch (11), is so arranged and positioned that an arm (60) can be brought into engagement with the switch (11), when the box is empty.

6. A box according to claim 3, characterized in that the bottom plate (20) is slantingly provided on the bottom wall of the box and that an axis (31) of the pivotally mounted member (30; 60) is provided in the lower region of the bottom plate (20).

7. A box according to claim 3, characterized in that the pivotally mounted member (30) is shaped as a plate which in its initial position substantially covers the bottom plate (20).

8. A box according to claim 4, characterized in that the bottom plate (20) is slantingly provided on the bottom wall of the box and that an axis (31) of the pivotally mounted member (30; 60) is provided in the lower region of the bottom plate (20).

9. A box according to claim 5, characterized in that the bottom plate (20) is slantingly provided on the bottom wall of the box and that an axis (31) of the pivotally mounted member (30; 60) is provided in the lower region of the bottom plate (20).

10. A box according to claim 2, characterised in that the bottom plate (20) is slantingly provided on the bottom wall of the box and that an axis (31) of the pivotally mounted member (30; 60) is provided in the lower region of the bottom plate (20).

11. A box according to claim 2, characterised in that the pivotally mounted member (30) is shaped as a plate which in its initial position substantially covers the bottom plate (20).

12. A box according to claim 1, characterised in that the pivotally mounted member (30) comprises at least one, elongate projections (32), one of which can be brought into engagement, from above, with a switch (11) through a corresponding opening (21) of the bottom plate (20), when the box is empty.

13. A box according to claim 1, characterised by a plate (40) pivotally mounted on the wall (3) of the box, a gap for the objects to be placed in the box being provided between the free end (43) of the plate (40) and the side wall (2) of the box when the plate (40) is in its resting position, in which the plate (40) inclines downwards from its axis (41), the plate (40) being carried by a return spring (42) in its resting position and the spring (42) allowing the plate (40) to be pivoted towards the wall (3) on which it is mounted.

14. A box according to claim 1, characterised in that the transmission is provided to transfer an angular velocity to the pivotally mounted member (30; 60) which is substantially higher than the angular velocity of the lid (7) when the lid (7) is opended.

15. A box according to claim 1, characterised in that the transmission comprises a pull wire (61), which with its one end is attached to the free end of the pivotally mounted member (30; 60) and with its other end is attached to one of the walls (2, 2*a*, 3, 4, 5 or 6) of the box, said pull wire extending glidingly through a ring (65) attached to one end of a pull spring (66), the other end of the pull spring being attached to the lid (7).

16. A box according to claim 1, characterized in that the box comprises an internal bottom plate (20) against which the pivotally mounted member (30; 60) acts in its initial position.

17. A box according to claim 1, characterized by a plate (40) pivotally mounted on the wall (3) of the box, a gap for the objects to be placed in the box being provided between the free end (43) of the plate (40) and the side wall (2) of the box when the plate (40) is in its resting position, in which the plate (40) inclines downwards from its axis (41), the plate (40) being carried by a return spring (42) in its resting position and the spring (42) allowing the plate (40) to be pivoted towards the wall (3) on which it is mounted.

18. A box according to claim 1, characterized in that the transmission is provided to transfer an angular velocity to the pivotally mounted member (30; 60) which is substantially higher than the angular velocity of the lid (7) when the lid (7) is opened.

19. A box according to claim 1, characterized in that the transmission comprises a pull wire (61), which with its one end is attached to the free end of the pivotally mounted member (30; 60) and with its other end is attached to one of the walls (2, 2*a*, 3, 4, 5 or 6) of the box, said pull wire extending glidingly through a ring (65) attached to one end of a pull spring (66), the other end of the pull spring being attached to the lid (7).

* * * * *

UNITED STATES PATENT AND TRADEMARK OFFICE

CERTIFICATE OF CORRECTION

PATENT NO. : 5,898,371

DATED : 27 April 1999

INVENTOR(S) : Yochai MAREK

It is certified that error appears in the above-indentified patent and that said Letters Patent is hereby corrected as shown below:

At column 8:

In claim 14 (column 8, line 32), change "opended" to --opened--.

Delete claims 16 to 19 (column 8, lines 41-66).

Signed and Sealed this

Twenty-eighth Day of September, 1999

*Attest:*

Q. TODD DICKINSON

*Attesting Officer*

*Acting Commissioner of Patents and Trademarks*